United States Patent [19]

Shepley et al.

[11] Patent Number: 5,005,554

[45] Date of Patent: Apr. 9, 1991

[54] BOW HANDLE RISER

[75] Inventors: Pete Shepley; Richard Johnston; Allan F. Smith, all of Tucson, Ariz.

[73] Assignee: Precision Shooting Equipment Company, Tucson, Ariz.

[21] Appl. No.: 197,294

[22] Filed: May 23, 1988

Related U.S. Application Data

[63] Continuation of Ser. No. 920,080, Oct. 17, 1986, abandoned.

[51] Int. Cl.[5] ..... F41B 5/10

[52] U.S. Cl. ..... 124/24.1; 124/25.6; 124/44.5; 124/88

[58] Field of Search ..... 124/88, 86, 87, 24 R, 124/23 R, 41 A, DIG. 1, 25, 24.1, 23.1, 25.6, 44.5, 900

[56] References Cited

U.S. PATENT DOCUMENTS

| | | | |
|---|---|---|---|
| 213,083 | 3/1879 | Thorne . | |
| 1,847,593 | 3/1932 | Cameron . | |
| 1,926,845 | 9/1933 | Folberth . | |
| 2,186,386 | 1/1940 | Lowell . | |
| 2,542,501 | 2/1951 | Fredrickson | 124/24.1 X |
| 2,960,084 | 11/1960 | Kramer | 124/24 R |
| 3,135,255 | 6/1964 | Hoyt | 124/24 R |
| 3,517,658 | 6/1970 | Shurts . | |
| 3,566,853 | 3/1971 | Larm . | |
| 3,623,468 | 11/1971 | Crest | 124/24 R |
| 3,698,375 | 10/1972 | Brougham | 124/24 R |
| 4,287,868 | 9/1981 | Schiff | 124/41 A |
| 4,350,138 | 9/1982 | Caldwell | 124/86 X |
| 4,421,092 | 12/1983 | Christian | 124/41 A |
| 4,621,606 | 11/1986 | Toth | 124/87 X |
| 4,662,346 | 5/1987 | Laffin | 124/24 R X |
| 4,704,800 | 10/1987 | Stinson | 124/88 X |
| 4,759,337 | 7/1988 | Suski | 124/88 X |

OTHER PUBLICATIONS

Archery, Dec. 1974, p. 7; Dec. 1971, pp. 12, 13, 38; May 1971, p. 11; Dec. 1970, pp. 30, 44; Mar. 1970, p. 19; Feb. 1955, p. 46; Apr. 1954, p. 48; Jul. 1959, p. 45; Dec. 1953, p. 31; Jul. 1953, p. 45.

Archery World, Sep. 1973, p. 58; Apr. 1970.

Martin Archery Catalog Pages, 1976.

Petersen's Bow Hunting May 1990, pp. 38–43.

*Primary Examiner*—Peter M. Cuomo

*Attorney, Agent, or Firm*—Jack E. Dominik

[57] ABSTRACT

An archery bow handle or riser, in which the riser is cut out sufficiently to permit a broad head arrowhead to pass rearwardly of the hand grip section, and upon release of the arrow, to avoid interference with the riser by both the broad head point as well as the vanes at the rear portion of the arrow is disclosed. Provision is made beneath the riser sight window offset to mount an arrow rest, which may interlock into a cutout, and which extends somewhat further offset in order to position the arrow on the centerline of the bow so that it will behave as an arrow fired with a prior-art type bow handle riser, but accommodating a shorter arrow with a broad head, and avoiding the frictional and deflecting contact of the vanes with the riser. Vane deflection may be a problem with any length arrow and any type of arrow head used on a bow without the sight window offset feature as set forth in the present invention.

18 Claims, 3 Drawing Sheets

BOW HANDLE RISER

CROSS-REFERENCE TO RELATED APPLICATIONS

The present application is a continuation of application Ser. No. 920,080, filed Oct. 17, 1986, now abandoned, by the same inventors herein and entitled Bow Handle Riser.

BACKGROUND OF THE INVENTION

1. Field of the Invention

The present invention relates to archery bows, and more particularly that type of bow having two limbs mounted on a central handle or riser portion with the handle portion containing a grip, and an arrow rest. More specifically the present invention is directed to a specific construction of the riser along with the accessory mounts.

2. Summary of the Prior-Art

Archery bows have existed for centuries. More recently the compound archery bow has become a favorite of hunters and target shooters. Such a bow is exemplified in Allen U.S. Pat. No. 3,486,495.

A long-standing problem with archery bows evolves around the support of the arrow when the bow is drawn as well as when the bow is released. A myriad of arrow rests have been developed. Most of these, however, do not position the arrow far enough away from the bow handle riser to avoid interference with the vanes as the rear portion of the arrow passes the riser. This is due to the design of the riser.

In addition, in order to impart as much kinetic energy and speed to the arrow as possible, they are normally quite long and drawn fully before release. With hunting arrows, particularly utilizing a broad head point whether it has two blades, three blades, or four blades, the same may interfere with the handle riser, and accordingly the draw of the arrow is limited. This requires a longer arrow when a broadhead is used.

In many situations, however, a shorter lighter arrow is desirable. If the same amount of force can be spent on a shorter lighter arrow, and it will carry the same amount of kinetic energy, then depending upon the increase in velocity, the trajectory of the shorter lighter arrow will be flatter than that of the longer heavier arrow. Particularly when hunting, and the conditions are not ideal as is on a target range, the shorter lighter arrow with the flatter trajectory gives the archer greater assurance of striking the target.

SUMMARY OF THE INVENTION

The present invention is directed to an archery bow handle or riser, in which the riser is cut out sufficiently to permit a broad head arrowhead to pass rearwardly of the hand grip section, and upon release of the arrow, to avoid interference with the riser by both the broad head point as well as the vanes at the rear portion of the arrow. Provision is made beneath the riser sight window offset to mount an arrow rest, which may interlock into a cutout, and which extends somewhat further offset in order to position the arrow on the centerline of the bow so that it will behave as an arrow fired with a prior-art type bow handle or riser, but accommodating a shorter arrow with a broad head, and avoiding the frictional and deflecting contact of the vanes with the riser. Vane deflection may be a problem with any length arrow and any type of arrow head used on a bow without the sight window offset feature as set forth in the present invention.

It, therefore, is a principal object of the present invention to provide a bow handle or riser with a cutout so that overdraw with any broad head point can be achieved, and deflecting or frictional engagement of the vanes when the arrow is released is avoided. Bow handles may also be designed with the offset clearance the full length of the window. This induces a problem in that conventional sights may not work in such an environment. The sight pins in that instance need to be made longer.

Another and important related object of the present invention is to provide a bow handle or riser with a sight window offset, but still preserve the features of a mounting bracket above the offset to permit securing such accessories as a bow sight, bow quiver, and arrow rest to the bow handle.

Yet another object of the present invention is to achieve the advantages of a bow handle or riser with a cutout such as set forth above in a construction which is inherently no more expensive than the prior-art bow handle risers.

BRIEF DESCRIPTION OF THE DRAWINGS

Further objects and advantages of the present invention will become apparent as the following description proceeds, taken in conjunction with the accompanying drawings, in which.

DESCRIPTION OF A PREFERRED EMBODIMENT

Figure 1:
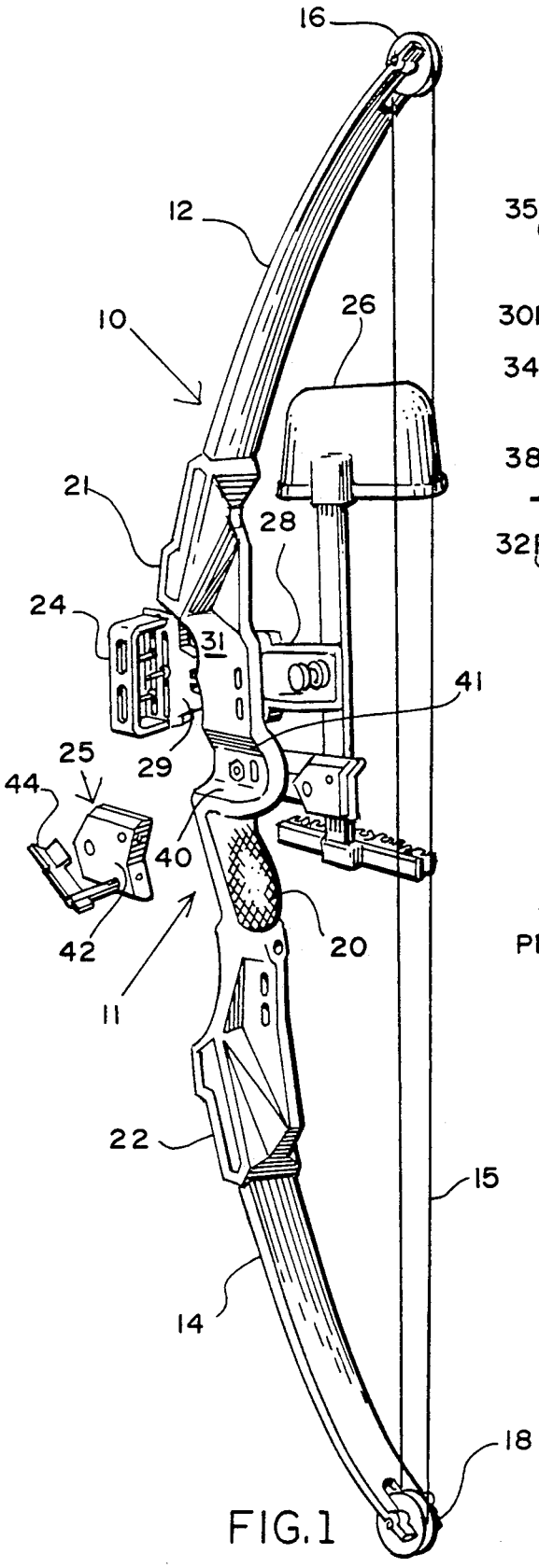
FIG. 1 is a perspective view of a typical bow illustrating the utilization of the riser exemplary of the present invention and showing optional accessories mounted in interlocking cutouts to the bow.

Turning now to FIG. 1, it will be seen that an archery bow 10 is illustrated which has a handle riser 11 to which is secured an upper limb 12, and a lower limb 14. The remote portions of the limb are joined by a bow string 15. In the present instance, the bow string 15 is shown with its relationship to the upper wheel 16 and the lower wheel 18. This construction is what is often referred to in the archery trade as a compound bow.

The present invention, however, can be utilized with a non-compound bow since it is directed primarily to the handle or riser section, and more specifically the sight window portion of the handle section.

The handle or riser 11 is provided at a lower portion with a grip 20 which is normally slipped over the casting of the handle 11, and is that portion of the bow which is grasped by the archer's hand. The handle or riser 11 has an upper limb mount 21, and a lower limb mount 22. The bow limbs 12, 14 are secured to those mounts by various techniques, but normally they are releasably secured for taking down the bow and adjusting the draw weight, or replacing the limbs. In shooting fashion, however, they are the equivalent to being permanently secured to the handle riser 11.

Accessories are common, particularly on hunting bows. As shown in FIG. 1, there is a bow sight 24, an arrow to the handle or riser 11 by means of the bow quiver bracket 28. The sight 24 is secured to the bow handle 11 by means of the sight bracket 29.

Central to the archery handle 11 is the sight window 30. The handle 11 has at its upper portion an accessory mount area 31. The handle 11 terminates at its lower portion in an overdraw offset base 32 which is immediately above the grip 20. That portion of the handle 11 which is on the arrow side of the sight window 30 of the handle or riser 11 is known as the sight window face 34. Opposite the sight window face 34 is a center line 35 which lies in the plane of the bow string 15.

Figure 2:
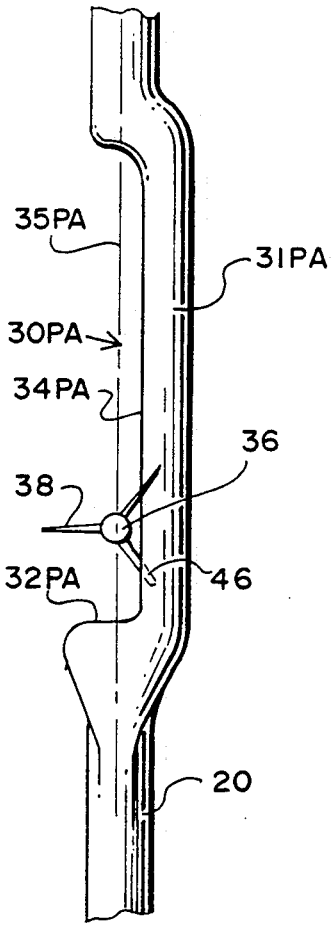
FIG. 2 PRIOR ART
FIG. 2 is a partially diagrammatic view of a prior-art bow riser illustrating the interference relationship between the vanes on an arrow and the riser face, and comparably illustrating why certain broad head points cannot be overdrawn.

Shown in FIG. 2 is the typical prior-art handle 30PA. It will be seen that the center line 35PA is the same as that of the illustrative invention. The handle section 31PA has a sight window face 34PA. As illustrated, the arrow 36 and its three vanes 38 could possibly interfere with the sight window face 34PA as the arrow passes through the center line 35PA. Similarly, when a broad head point is used on the arrow, it could possibly interfere with the prior-art sight window face 34PA and hence can only be drawn to the back of the handle or riser 30PA.

Figure 3:
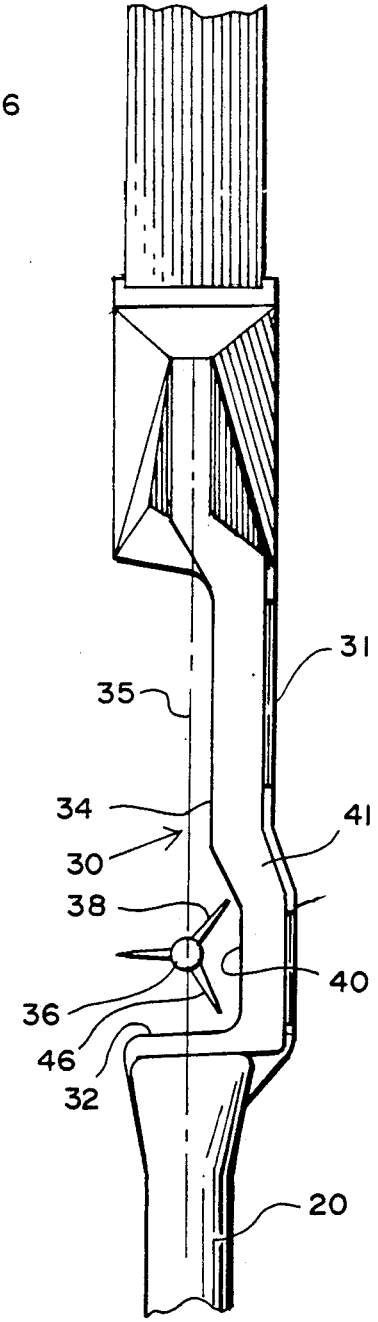
FIG. 3 is a view diagrammatically taken from the same vantage point as FIG. 2, but illustrating the bow handle riser illustrative of the present invention and more particularly showing how the clearance is provided for the arrow vanes as well as a broad head point, irrespective of whether the broad head point is two, three, or four bladed.

Central to the present invention, as shown in FIG. 3, is the provision of a sight window overdraw offset 40 extending upwardly from the overdraw offset base 32, and terminating with an overdraw offset return 41 which rejoins the handle 11 prior to the sight window face 34 joining the upper limb mount 21.

Figure 4:
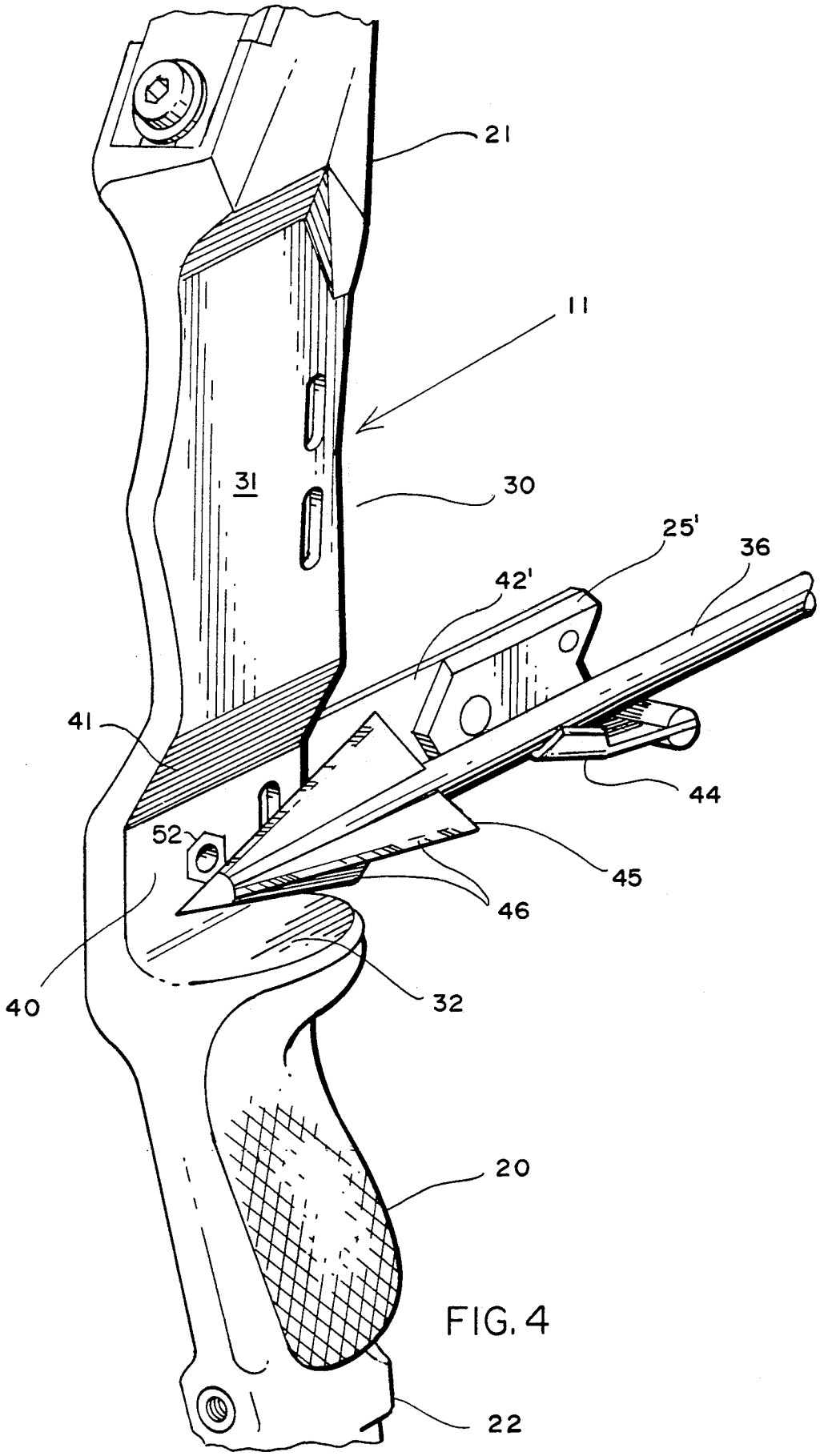
FIG. 4 is a partially broken perspective view showing the relationship between a broad head point of an arrow the arrow rest, and the riser illustrative of the present invention.

Turning now to FIG. 4, it will be seen that above the overdraw offset return 41, the accessory mount area 31 is positioned to receive both the bow sight 24 and/or the bow quiver 26. These are joined to the accessory mount 31 by the bow quiver bracket 28 and the sight bracket 29. The arrow rest 25, or 25' which is an alternative construction, are secured by means of an arrow rest bracket 42 to the outside portion of the sight window overdraw offset 40. Conventional mounting means are employed. The arrow rest assembly 25 as shown in FIG. 1 is a conventional type, and mounts in a recess, such as shown as 51 in FIG. 5, to receive various state of the art arrow rests. The alternative embodiment arrow rest 25' (FIG. 4) is secured by means of its mounting bracket 42' to the same location on the outside of the sight window overdraw offset 40, as shown in FIG. 4. With the alternative embodiment arrow rest 25', as shown in FIG. 4, an extension rod and fingers 44 extend outwardly to cradle the arrow 36 along its shaft, and extend sufficiently rearwardly so that the broad head 45 can pass the sight window 30, thereby permitting a shorter arrow to be used in a full drawn configuration, and avoiding contact by the broad head blades 46 with the sight window overdraw offset 40. Thus when the shorter arrow is used it can be in effect, overdrawn, without an overdraw modification to the bow. Thus the shorter arrow can be used with the flatter trajectory in hunting configuration, with the twofold advantage of being able to be overdrawn without an overdraw accessory, and with provision for the vanes to pass the bow handle or riser without physical interference thereby avoiding deflection, friction, and unwanted instability in flight.

Figure 5:
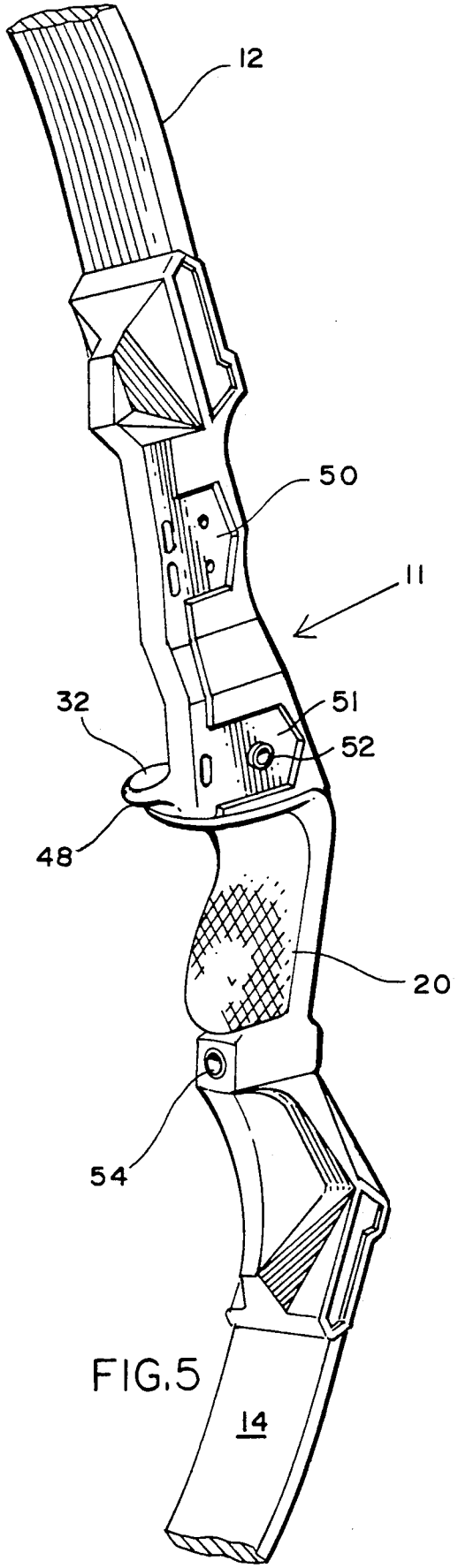
FIG. 5 is a further perspective partially broken view of the bow handle riser without accessories and illustrating several of its details.
Figure 6:
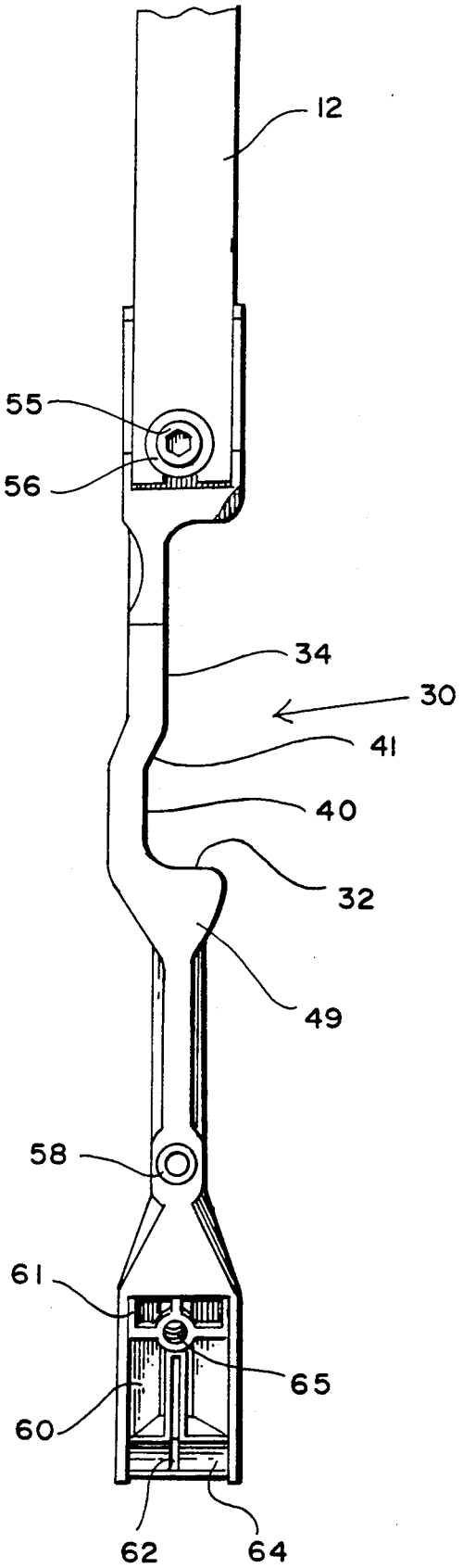
FIG. 6 is a front elevation of the perspective shown in FIG. 5 looking in the direction toward the shooter which would be a view from the right looking leftwardly at FIG. 5.

Further details of the subject handle 11 are shown in FIGS. 5 and 6. There it will be seen that the face of the riser 48 is opposed by a back of the riser 49. A sight-/quiver recess 50 is positioned upwardly of the overdraw offset base 32. The arrow rest overdraw recess 51 is opposite the sight window overdraw offset 40. A rest overdraw bushing 52 is provided in the arrow rest overdraw recess 51 for mounting the same. A cable guard bushing 54 is provided beneath the grip 20. The weight adjustment limb bolt 55 is positioned at the base of the upper limb 12, and is put in in combination with a limb bolt washer 56. The stabilizer bushing 58 is mounted opposite the cable guard bushing 54 as shown in the lower portion of FIG. 6.

The limb socket area 60 is detailed at the lower portion of FIG. 6. It includes a butt alignment pad 61, a limb half-round alignment bar 62, and a limb half-round seat 64, all of which receive the preformed end of the limb for securement by means of the limb bolt 55 such as shown in the upper portion of FIG. 6. There is also provided a steel limb bolt threaded insert 65 as shown in the lower portion of FIG. 6.

As set forth above, the entire bow handle or riser 11 can be cast of a single casting, and therefore the inherent expense remains essentially the same as the prior-art bow handle or riser. It can also mount the same accessories as the prior-art bow handle or riser, and provides for an arrow rest which will position the arrow along the center line of fire for release when the vane rear portion of the arrow passes the arrow rest.

Although particular embodiments of the invention have been shown and described in full here, there is no intention to thereby limit the invention to the details of such embodiments. On the contrary, the intention is to cover all modifications, alternatives, embodiments, usages and equivalents of the subject invention as fall within the spirit and scope of the invention, specification, and the appended claims.

What is claimed is:

1. A bow handle for use with an overdraw arrow support having means for supporting an arrow with an arrowhead and vanes in an overdraw configuration, said handle having a hand grip, an upper limb mount, a lower limb mount and a pair of limbs, a bow string between the ends of said limbs, said bow string as drawn defining a bow string plane, said handle comprising, a sight window face displaced from the plane of the bow string, a sight window overdraw offset adjacent the hand grip and offset from the sight window face and the plane of the bow string to provide clearance for the arrowhead and the vanes of said arrow, a sight window overdraw offset base adjacent said hand grip, said sight window face being between said sight window overdraw offset and said upper limb mount, said sight window overdraw offset having a sight window overdraw offset return remote from the base and terminating at the sight window face.

2. For use with an archery bow having a pair of limbs, a handle, said handle having a hand grip, an upper limb mount and a lower limb mount, a bow string between the ends of said limbs, said bow string as drawn defining a bow string plane for use with an overdrawn arrow with an arrowhead and vanes, said handle having a sight window face displaced from the plane of the bow string, a sight window overdraw offset adjacent the hand grip and offset from the sight window face and the plane of the bow string to provide clearance for the arrowhead and the vanes of said arrow, a sight window overdraw offset base adjacent said hand grip, said sight window face being between said sight window overdraw offset and said upper limb mount, said sight window overdraw offset having a sight window overdraw offset return remote from the base and terminating at the sight window face, and means for securing an arrow rest between a midpoint in the sight window overdraw offset and a position rearwardly of said handle, whereby clearance for both the arrowhead and arrow vanes permit non-interference with the sight window overdraw offset.

3. In the archery bow handle of claim 2, said handle sight window and offset portion above the hand grip having substantially constant thickness.

4. An archery bow handle having a hand grip and upper and lower limb mount portions for use with an archery bow and arrow in which said arrow has vanes and a broadhead point;

an accessory mount remote from the hand grip, a sight window overdraw offset adjacent said grip, a sight window face between the sight window overdraw offset and the upper limb mount, said sight window overdraw offset having an offset from said sight window face to provide a clearance for a broadhead arrowhead and the vanes of an arrow, means on said sight window overdraw offset to mount an arrow rest rearwardly of the sight window overdraw offset, said accessory mount positioned on the side of the handle opposite said sight window face and above said sight window overdraw offset in predetermined spaced relationship to thereby accept bow sights or quivers.

5. In the archery bow handle of claim 4, said accessory mount being proportioned to mount a sight.

6. In the archery bow handle of claim 4, means on said accessory mount to mount a bow quiver.

7. In the archery bow handle of claim 4, means on said accessory mount to mount both a sight and a bow quiver.

8. In the archery bow handle of claim 4, means on said accessory mount to mount both a sight and/or bow quiver on the opposite side of the handle to the sight window face.

9. In the archery bow handle of claim 4, said bow handle sight window and offset portion above the hand grip having a substantially constant thickness.

10. An archery bow for use with an overdraw arrow having an arrow head and vanes, said bow comprising:

a handle with upper and lower limb mounts and a hand grip;

a pair of limbs each secured to a respective one of said limb mounts;

a bow string extending between an end of each of said limbs, said bow string defining a bow string plane as it is drawn;

said handle having a sight window face displaced from said bow string plane; and a sight window overdraw offset adjacent said hand grip and offset from said sight window face and said bow string plane to provide clearance for the arrowhead and the vanes of said arrow, and means for securing an arrow rest between a position adjacent said sight window overdraw offset to a position rearwardly of said handle.

11. In the archery bow of claim 10, an arrow rest, and means for securing an arrow rest between a midpoint in the sight window overdraw offset to a position rearwardly of said handle, whereby clearance for both the arrowhead and arrow vanes permit non-interference with the sight window overdraw offset.

12. In the archery bow of claim 10, means to mount a sight adjacent the sight window face and secured opposite the sight window face.

13. In the archery bow of claim 10, means on said sight mount portion to mount a bow quiver at a position opposite the sight window face.

14. In the archery bow of claim 10, means on said sight quiver mount portion to mount both a sight and a bow quiver.

15. For use with an archery bow having a pair of limbs, a handle, said handle having a hand grip, an upper limb mount and a lower limb mount, a bow string between the ends of said limbs, said bow string as drawn defining a bow string plane for use with an overdrawn arrow with an arrowhead and vanes, said handle having a sight window face displaced from the plane of the bow string, a sight window overdraw offset adjacent the hand grip and offset from the sight window face and the plane of the bow string to provide clearance for the arrowhead and the vanes of said arrow, a sight window overdraw offset base adjacent said hand grip, said sight window face being between said sight window overdraw offset and said upper limb mount, said sight window overdraw offset having a sight window overdraw offset return remote from the base and terminating at the sight window face, and means for mounting means for supporting said arrow sufficiently above said overdraw offset base and rearwardly of said handle to permit said arrow to be overdrawn.

16. In the archery bow handle of claim 15, said means for mounting means for supporting said arrow sufficiently above said overdraw offset of said base to permit the vanes and arrowhead to pass said handle without touching the same.

17. In any of claims 2, 4, 10, and 15, said handle in combination with a compound archery bow.

18. A compound archery bow having a handle, a pair of limbs, said handle having a hand grip, an upper limb mount and a lower limb mount, a bow string between the ends of said limbs, said bow string as drawn defining a bow string plane for use with an overdrawn arrow with an arrowhead and vanes, said compound bow having pulleys at each end, and said bow string being operably connected to said pulleys, an accessory mount remote from the hand grip, a sight window overdraw offset adjacent said grip, a sight window face between the sight window overdraw offset and the upper limb mount, said sight window overdraw offset having an offset from said sight window face to provide a clearance for a broadhead arrowhead and the vanes of an arrow, a sight window overdraw offset base adjacent said hand grip, said accessory mount positioned on the side of the handle opposite said sight window face and above said sight window overdraw offset in a predetermined space relationship to thereby accept bow sights or quivers, means for mounting means for supporting said arrow sufficiently above said overdraw offset base to permit said arrow to be overdrawn, said means for mounting means for supporting said arrow sufficiently above said overdraw offset base and rearwardly of said handle to permit the vanes and arrowhead to pass said handle without touching the same.

* * * * *